US008006894B1

(12) United States Patent
Rouverol

(10) Patent No.: US 8,006,894 B1
(45) Date of Patent: Aug. 30, 2011

(54) SAVE DEMOCRACY ELECTION SYSTEM

(76) Inventor: William Rouverol, Berkeley, CA (US)

( * ) Notice: Subject to any disclaimer, the term of this patent is extended or adjusted under 35 U.S.C. 154(b) by 765 days.

(21) Appl. No.: 12/148,393

(22) Filed: Apr. 18, 2008

Related U.S. Application Data

(63) Continuation-in-part of application No. 11/973,463, filed on Oct. 9, 2007, now Pat. No. 7,857,200.

(60) Provisional application No. 60/927,064, filed on Apr. 30, 2007.

(51) Int. Cl.
*G07C 13/00* (2006.01)

(52) U.S. Cl. ..... 235/51; 235/386

(58) Field of Classification Search ..... 235/386, 235/454, 50 B, 51, 54 F, 55 B, 56, 383
See application file for complete search history.

(56) References Cited

U.S. PATENT DOCUMENTS

| | | | | |
|---|---|---|---|---|
| 3,201,038 | A * | 8/1965 | Harris | 235/50 R |
| 4,021,780 | A * | 5/1977 | Narey et al. | 235/54 F |
| 7,621,449 | B1 * | 11/2009 | Biggins et al. | 235/386 |
| 7,857,200 | B1 * | 12/2010 | Rouverol | 235/51 |
| 2004/0046021 | A1 * | 3/2004 | Chung | 235/386 |
| 2005/0056698 | A1 * | 3/2005 | Cummings et al. | 235/386 |
| 2006/0202031 | A1 * | 9/2006 | Chung et al. | 235/386 |
| 2008/0290163 | A1 * | 11/2008 | Strabone | 235/386 |

* cited by examiner

*Primary Examiner* — Thien M Le
(74) *Attorney, Agent, or Firm* — Howard Cohen

(57) ABSTRACT

An election system is disclosed that is immune to rigging, costs only 5 to 20 percent of that of prior art e-voting systems, and entirely eliminates wasted voter time spent standing in line. The method used in the new system is to print each separate office or proposition on a separate playing-card size card adapted to be inserted in a separate ballot box while by means of an odometer the official reception of the voter's vote is shown to the voter by the odometer display.

19 Claims, 3 Drawing Sheets

SAVE DEMOCRACY ELECTION SYSTEM

CROSS-REFERENCE TO RELATED APPLICATIONS

This application is a continuation-in-part of application Ser. No. 11/973,463, filed Oct. 9, 2007, now U.S. Pat. No. 7,857,200 which claims filing date priority based on U.S. Provisional Application 60/927,064, filed Apr. 30, 2007.

FEDERALLY FUNDED RESEARCH

Not applicable.

SEQUENCE LISTING, ETC. ON CD

Not applicable.

BACKGROUND OF THE INVENTION

1. Field of the Invention

This invention generally relates to methods for reducing the vulnerability of election procedures to rigging and hacking. Specifically, it relates to election procedures that avoid the use of electronic voting and vote tabulation that have both been shown to be extremely easy to manipulate because they are driven by computer programs that can readily be altered by putting "patches" onto the computer source code.

2. Description of Related Art

Applicant knows of no prior art that teaches the method of dividing the full-page ballot into a large number of small cards, each of which lists the candidates for a single office or a single initiative proposition, while the voting booth provides separate ballot boxes for each candidate and proposition choice.

BRIEF SUMMARY OF THE INVENTION

The present invention has four goals. The main goal is to eliminate election rigging and hacking. The three secondary goals are also highly desirable. They include: (1) Enhanced Security; (2) Reduced cost; and (3) Increased speed, so that voters will not have to wait in line to vote. The extent to which these four goals have been met will be evident when the preferred embodiments have been fully described.

The invention includes a method for conducting elections in which voters cast ballots for candidates for office, propositions, and other questions that are typically put to the citizens in federal, state, and local elections. The method includes the steps of creating and printing ballots comprised of a plurality (or deck) of cards, each card displaying the candidates for a single office, or a single proposition, or the like. Thus each voter who votes at a polling place is given a deck of ballot cards on which the voter marks the selected candidate(s), and enters Yes/No choices (or the like) for propositions and other issues on the ballot. The method includes the step of providing a receptacle at the polling place that is comprised of a plurality of separate boxes, each labeled to correspond to one of the ballot card categories, and each including a slot to accept a ballot card therein.

A salient feature of the invention is the provision of a mechanism and method step for tabulating the insertion of a ballot card in a ballot box and maintaining a running count of the ballots inserted in each of the plurality of ballot boxes in each polling booth. Since each candidate and proposition choice has a separate and unique box, the invention generates an accurate count of the number of votes cast in each polling place. This count must not exceed the actual number of ballot cards issued; otherwise, there is prima facie evidence that there has been tampering with the ballots or the tabulation count. Moreover, the counter that logs the casting of each ballot card into its ballot box is arranged to be viewed by the voter, at least to the extent of seeing the rightmost (least significant) digit of the counter incremented as the ballot card is inserted, so that the voter may confirm that each of his/her ballot cards has been counted and tabulated.

DETAILED DESCRIPTION OF THE INVENTION

Figure 6:
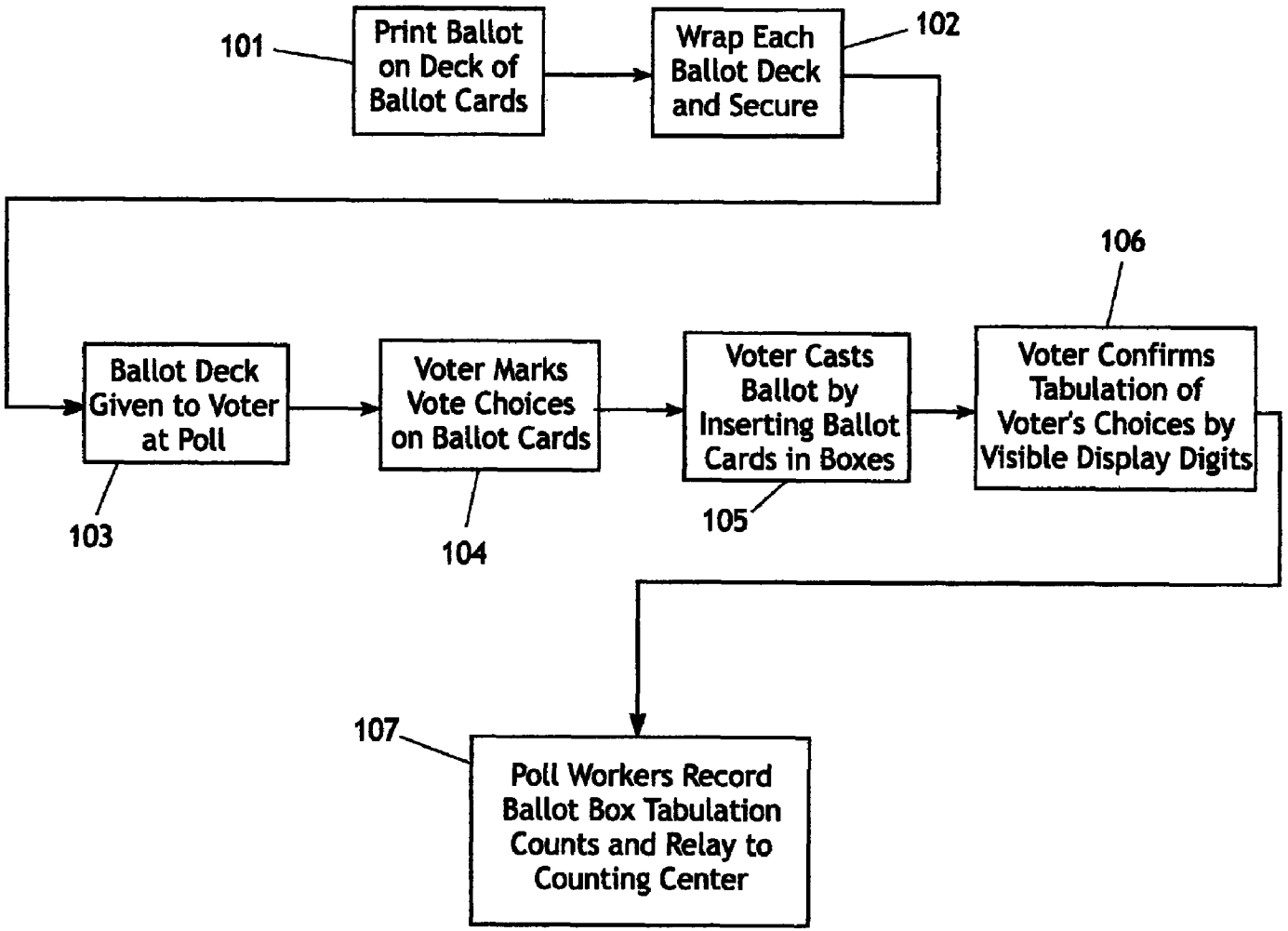
FIG. 6 is a flow chart that depicts the steps of the voting method of the invention.

Because the invention herein disclosed is primarily a method of reducing or eliminating fraud in elections, it is best described with reference to the flow diagram of FIG. 6, with seven steps depicted in a series. The working of the invention can then be described in a verbal disclosure of the seven steps, in the correct sequence, of what happens to a typical ballot.

The first step 101 in the flow diagram is the printing of the ballot, which consists of a deck of small cards about the size of an ordinary playing card. Each card is typically two and a half inches by three and a half inches, and about ten thousandths of an inch thick. Each card lists the names of all the candidates for one (and only one) particular office (president, governor, senator, congressman, etc., or one particular "yes" or "no" initiative proposition. The entire ballot might consist of 20 or 30 cards or sometimes even more. All the cards are the same size.)

The second step 102 is that for security, there is a paper wrapping that identifies the state, county and precinct of the election. Several hundred of these ballot decks are distributed to the check-in attendant of each precinct (as well as several hundred to the County Clerk for use in behalf of absentee voters).

The third step 103 is to provide the voter with a ballot deck. When he/she enters the precinct, the voter's name is crossed off the registration list by the check-in attendant, who hands the deck to the voter.

The fourth step 104 is taken when the voter takes his/her deck to a vacant position at one of the "work place" card tables set up in the polling place. Each table has four chairs and on the table top an X-shaped screen about three feet high which gives each voter temporary privacy while he/she marks (or punches, as the case may be) his/her ballot cards. The cards are arranged in numerical order.

The fifth step 105 is taken when the voter takes his/her marked (or punched) cards (typically, a deck of ballot cards) to a curtained voting booth. The voting booth has a plurality of small ballot boxes, up to several dozen, each about six inches deep, 3.0 inches (76.2 mm) wide, and about 5 inches in height, and arranged in adjacent stacks. The number of these ballot stacks is exactly the same as the number of ballots cards each voter has been given, and each stack has a primary label that matches the office (or initiative proposition) on one of the voter's ballot cards. Each stack is comprised of several small ballot boxes mounted one above the other, and each is the precinct's sole depository for one of the choices for one of the candidates or propositions.

The sixth step 106 coincides with the fifth step, because it is a confirmation step. Each of the ballot boxes has an odometer that is geared directly to the ballot card, so that as it is inserted, it changes the final digit of the odometer, e.g., 0 goes to 1, 1 goes to 2, etc. As the odometer display is adjacent to the card slot, the voter can see every one of his votes added to the official vote total as he pushes in each card.

As the seventh and final step 107 in the working of the herein disclosed invention, which is taken at the moment the polls close, a bipartisan poll team unlocks the small screens that conceal all of each odometer display except the final digit, so that the official precinct totals can be read, recorded, and witnessed by all party representatives on duty at closing time.

In carrying out the method of the invention many mechanical and electrical means are available; the least expensive and most efficient one appears to be the rack-and-pinion system illustrated in the drawings for the purposes of the system described herein. The particular adaptation of the rack-and-pinion concept appears to have several unique features:

1. The "rack" member is simply a card about 0.010 inches (0.254 mm) thick, with holes instead of protruding teeth.
2. The "pinion" member has teeth, but they are unlike conventional involute teeth. They are tapered circular-section pins with involute profiles, having pointed tips.
3. Instead of a standard 14.5 or 20 degree pressure angle, the pressure angle is zero.
4. The teeth are much finer than conventional gear teeth, by about twice.
5. The contact area between mating teeth is a small concave-convex zone.

Figure 1:
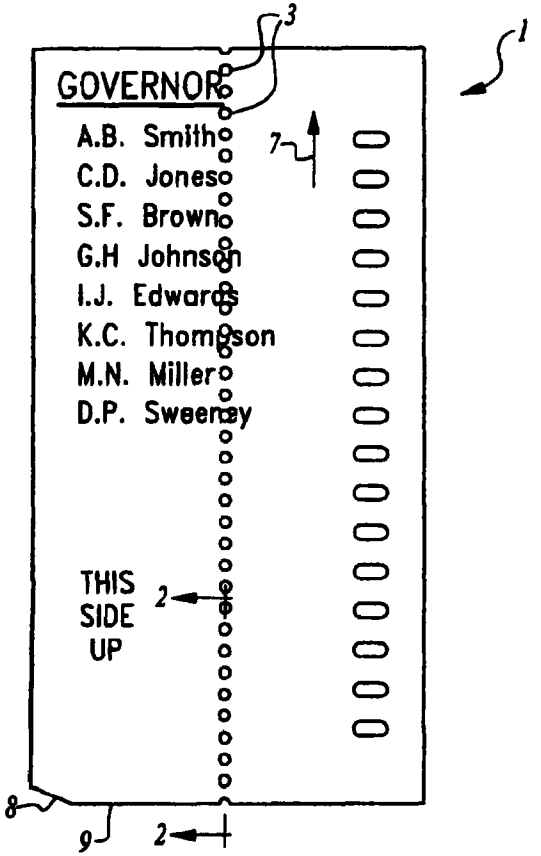
FIG. 1 is a plan view of a typical ballot card formed in accordance with the present invention.

With reference to the drawings, FIG. 1 shows a plan view of a typical ballot card 1, showing the row of holes arrayed along a longitudinal line that allow the card to engage the pinion gear and cause it to rotate as the card is inserted into the ballot box slot.

Figure 2:
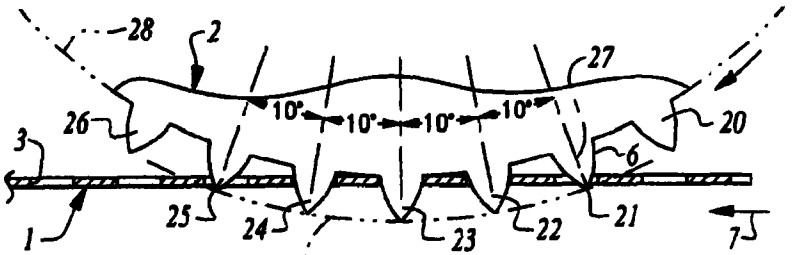
FIG. 2 is a cut elevation showing the ballot card engaging the pinion of the ballot tabulating mechanism of the invention.

FIG. 2 is a cut elevation showing the card 1 engaging the pinion, and causing it to rotate in proportion to the lengthwise movement of the card, while the involute arc profile of its teeth causes the line of action of the meshing process to keep the pressure line tangent to the pitch circle of the pinion teeth. In order for one full length movement of the card to produce exactly 360 degrees of rotation of the odometer drive shaft, it is usually convenient to have the number of holes in the card equal to the number of teeth on the pinion. The only exception to this is when the pinion is separated from the odometer drive shaft by at least one idler.

Figure 3:
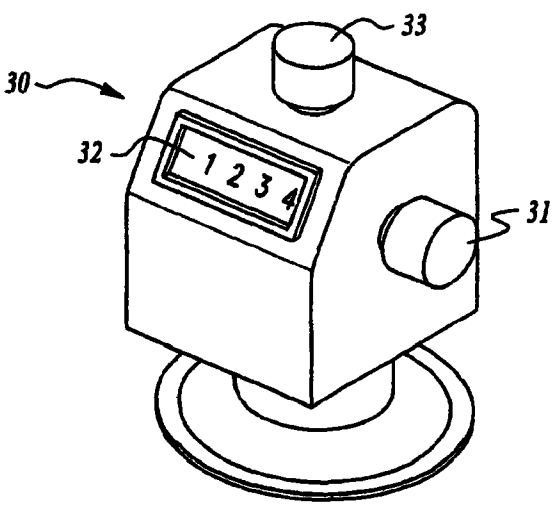
Fig. 3 (Prior Art)
FIG. 3 is a perspective view of a typical prior art odometer and display that may be employed in the present invention.

FIG. 3 shows what is generally called a "counter" but in this specification is called an "odometer" 30, to avoid confusion with the elongated shelf where payment for retail purchases or check-out is transacted. The term "odometer" is also familiar to automobile owners or passengers because it meters mileage driven. A true odometer tabulates only mileage, but the internal construction is the same as the mechanical counter of FIG. 3 which is simply a display of several digits reflecting a series of ten-to-one gear pairs each of which controls one digit of a total number. In our case, for a single precinct, the maximum display needed is 999. The device of FIG. 3 is of course prior art, as a new use of an old device. Features in FIG. 3 are the drive shaft 31, the odometer 30, display digits 32, and the reset button 33.

Figure 4:
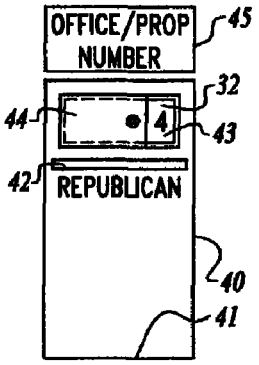
FIG. 4 shows a front elevation of a typical ballot box embodying the invention.

FIG. 4 shows a front elevation of a typical ballot box 40, also termed herein a "module", embodying the invention. Each box 40 has an odometer 30 that counts and displays the number of ballot cards 1 inserted through its slot 42. In practice, only the rightmost digit 43 is visible to the voter.

Figure 5:
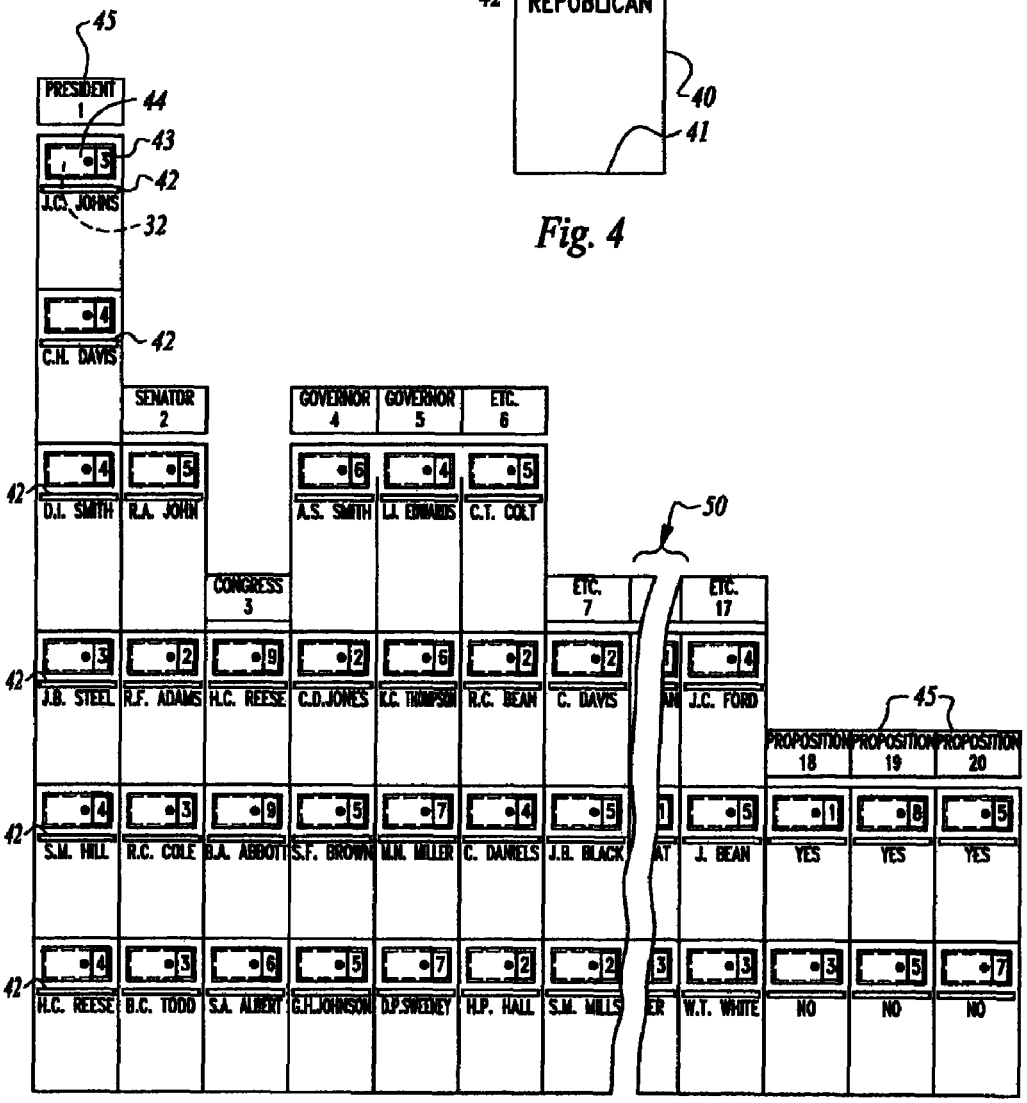
FIG. 5 shows a front elevation of a complete set of ballot boxes such as shown in FIG. 4, fastened together for placement in a voting booth.

FIG. 5 shows a front elevation of a set of ballot boxes 40 such as shown in FIG. 4 fastened together for placement in the curtained booth (not shown). The several modules shown are arranged in a spacial horizontal and vertical manner that is optimally convenient to the voter.

DESCRIPTION OF THE PREFERRED EMBODIMENTS

In detail and again referring to the drawings, FIGS. 1 and 2 describe and compare to a conventional involute rack-and-pinion gear set a special gear form wherein a flat card 1 is restrained at the top, bottom and sides so it can move only in a lengthwise direction to rotate a pin wheel 2 rotatably connected to an odometer 30 without buckling or binding, and sized so that one card length of transverse movement of the card produces 360 degrees of the odometer drive shaft rotation.

As stated above, FIG. 1 is a plan view of a typical ballot card 1. It lists the candidates for a single issue such as "Governor" or a single initiative proposition. The design length is 3.600 inches (91.44 mm) and the chosen number of teeth 20-24 on the pinion 2 ("pin wheel") is 36. The design pitch, if there is no idler is 3.6/36=0.100 inches (2.54 mm). This is the distance between the centers of adjacent holes 3 and also the arc distance between adjacent teeth 21, 22 (e.g.) measured on the pitch circle 28 of the pinion 2 between corresponding points on the active tooth profile 6.

As will be seen on FIG. 1, the particular office to which this ballot card 1 applies is Governor, which is shown in large type, as is the lengthwise arrow 7 showing which end of the card 1 is to enter the slot 42 on the ballot box 40 first. Because the line of holes 3 in FIG. 1 is centered, it allows insertion of the card 1 either upside down or backwards or both. Wrongly oriented cards will be processed by the odometer as a correct vote for the intended party, but while a corner 8 removal will disclose a card 1 orientation error, the preferred error-control system is to cut a small "V" notch on one edge of each ballot card 1 at a slightly different distance from a card corner, depending on the card index number (e.g., 0 to 20 or 30). At the end of the election day, when the cards 1 are removed from the ballot boxes 40 and stacked, all the V's of each ballot box collection will be aligned except those few that are on ballot cards that have either an orientation error or a wrong-slot error. When these erroneously inserted cards are pulled and placed properly, the appropriate corrections in both the affected odometer totals can be made.

It may be seen from FIG. 2 (much enlarged, 10×), card 1 rides under tooth 20 and makes initial contact with pinion 2 on the active profile 6 of tooth 21, at a point that is close to the trailing edge 9 of the leading card 1 of the preceding voter. This confirms that FIG. 2 shows two cards 1. One is at the right and butts against the leading card 1 on the centerline of tooth 21 at 27. The leading card 1 is in contact with four pinion teeth 22, 23, 24, 25, but then rides under tooth 26 so there is not interference in the mesh. Both cards 1 are constrained top and bottom by flat plates (not shown) that are separated by say 0.012 inches if the card thickness is say 0.010 inches (0.254 mm), and the leading card 1 is closely supported for the distance from tooth 21 to slightly beyond tooth 25. The voter's hand (not shown) moves the trailing card 1 through this distance, until it's trailing edge 9 passes tooth 25, clears tooth 26, and then is free to drop by gravity into storage at the lower portion of the ballot box 40 in one of the compartments illustrated in FIG. 4. This movement of the leading card 1 will rotate the drive shaft of the odometer about 30 degrees of a full 360 degree rotation, which is too small to show any portion of the next integer on the odometer display. To minimize this effect, it is recommended that the minus 20° of rotation of pinion 2 (the centerline of tooth 21) be connected to the 000 position of the odometer 30.

It should also be noted that FIG. 2 can be inverted, but there are two advantages to the orientation shown: One is that if the right half of pinion 2 is within the lead card 1 gravity drop space, interference could occur. Putting the pinion 2 above card 1 eliminates this possibility; and secondly, it keeps the odometer display above the card 1 insertion slot 42, so the voter's hand is well removed from the sight-line toward the odometer display 32. Two additional features shown in FIG. 2 are the pinion 2 pitch circle 28 and tooth tip circle 29.

FIG. 3 is an illustration of a commercially available "mechanical counter" 30. This type of odometer is quite inexpensive and comes in two different actuation forms: punch button or shaft rotation. As indicated in FIG. 2, the preferred form is the latter. The range of the display 32 shown is 0000 to 9999, whereas the odometer suited for precinct vote totals need only have a 000 to 999 range. A means to return the display to 000 such as the reset button 33, is of course essential. At least as important is a means (not shown) to prevent the mechanical counter 30 from being driven backwards. This could be a conventional ratchet connected to the input gearing of the counter 30, for example.

FIG. 4 is a front elevation of a typical ballot box 40. It has a horizontal slot 42 slightly over 2.50 inches (63.5 mm) wide, and an odometer display 32, preferably above it. The odometer display 32 has a small locked panel 44 adapted to conceal from the voter all the digits of the display 32 except the right-most digit 43. The module has an access opening (not shown) at the back of the box 40. At the top of box 40 is a label 45 identifying which office or proposition the box 40 is for (e.g., "Governor") and below the slot 42 is a label identifying the candidate or proposition choice of that slot. Also, to make sure that there is no space between adjacent ballot cards 1, a shallow recess (not shown) should be made on the lips of the slot 42, usually at the right end, so that the fingers of the voter can push his/her ballot card 1 all the way to point 27.

FIG. 5 is a front elevation of an assembly 50 of ballot boxes ("modules") 40, each stacked one above the other, and the stacks being laterally adjacent and abutting each other. FIGS. 4 and 5 indicate that a "module" includes a slot 42, and odometer 30, an odometer display 32, and a suitable housing. When two or more modules are assembled together as shown in FIG. 5, the combination provides a horizontal-vertical distribution of modules that is particularly easy for the voter to understand. In this form of module arrangement, each of the candidates for each office and each of the Yes/No/responses for each proposition question are provided with a respective module. Each vertical stack has all the choice modules for a single office contest or proposition. In the layout shown, the public office contests choices are at the leftmost portion of the modular array, and the propositions are at the rightmost portion. Typically, there would be several time the number of modules in the leftmost stacks compared to the right, since there are usually many candidates for each office, but each proposition has only two choices (Yes/No). (As shown in FIG. 5, it may prove desirable to divide the candidates for one contest into two or more adjacent stacks if there are more than six candidates for a particular office and the stack would otherwise be too high.) This system has the great advantage of not requiring any manual counting, so exact totals can be read from the odometer displays 32 the instant the polls close.

As soon as the polls are closed, the small panels that conceal the second and larger odometer digits may be unlocked. Since the witnessed recordings of the odometer totals constitute the official election results, all possible efforts must be made to ensure that these totals include no rigged votes. The great advantage of the above described voting system is that it is totally cheat-proof. This is true both at the county level and the precinct level. The number of valid ballot decks is a matter of counting the lined-out registration names at the precinct check-in counter, and at the county level an addition of absentee decks distributed to party representatives at the county seat.

Many states have absentee votes that exceed the number of precinct votes; in Oregon, 100% of the votes are absentee. There is certainly no point in installing a rigging-free tabulation system that eliminates cheating at the precinct level while allowing it to occur with the absentee ballots. This is why the processing of absentee ballots must follow essentially the same steps as those followed in the precinct, with the sole exception of who slides the ballot cards 1 into the slots 42 of the ballot boxes 40. To make sure that this operation does not become a source of corruption, it must be overseen by a plurality of voter proxies of proven party loyalty.

The job of proxy voter is obviously a position of major responsibility, as well as needing extensive time and effort each time a fresh batch of absentee ballot cards 1 arrives at the county seat. Happily, most of the work of the proxy voters can be done well in advance of election day, as all of the odometers will have been bi-partisan certified and sealed against the electronic tampering that has now become routine with e-tabulation.

It should be noted that while rigging is unmistakably exposed in the first few seconds after poll closure, simply by comparing the major odometer 32 sums with the number of official ballot decks given out at the precinct registration check-in, so that the official returns can be disqualified pending an investigation, including a full analysis of which party stood to profit by the insertion of counterfeit ballot cards. The U.S. Treasury Dept. has great capability and experience in detecting counterfeited items, but most analysis takes time and precinct returns must remain in limbo until they are cleared from the charge of rigging.

In the ensuing claims, the word "issue" is intended to mean office or initiative (referendum) proposition, as the case may be.

"Save Democracy" in the title of this patent application is meant to be taken literally. Computer owners who have viewed the program www.electionfraudanalyzer.net, and who have thought for themselves about the exposures of that program, may (hopefully) find the courage to fight to get democracy back.

Here are the advantages in security, low-cost, and high speed that the above-described election reform affords:

Security: This is an "all-or-nothing" characteristic. A system that can be rigged will be rigged, so it has zero security. The reason that the above-identified system is totally unique is that it cannot be rigged. No other election system has this feature, and every other election system therefore has an inherent zero security. Here is why: Before registration was introduced, it was extremely common to rig elections by "stuffing" the ballot box. Registration changed all that. The crossing out of names on the official registration lists provided a way to determine exactly how many votes were valid.

If the total vote exceed that number, the excess votes were immediately identifiable as "stuffed" and the riggers quickly changed their method to switching. For every increase in one party's vote, there had to be an equal decrease in the aggregate votes for other parties. In the 2004 general election, reliable and impartial statisticians calculated that several million votes were switched, mostly from the minor parties to one or the other of the major parties. All ten of the so-called "swing states" were heavily rigged, and three of the more populous states suffered a change of plurality as a result of switched votes. All of these switched votes could not have accrued if the official returns had been based on counters that could not be made to run in reverse, and vote casting and tabulation were simultaneous. This will explain why the foregoing specification step stipulates that all of the mechanical counters 30 to be used in the above-described election system are to be constructed to prevent operation backwards. This is one thing that gives the system its unique 100% security rating.

Cost: In the herein proposed system, the voter does his/her deliberation, of perhaps 15 to 25 minutes, at a low-cost card table, then slides his 20 or so ballot cards in the matching slots in perhaps two or three minutes, in the voting booth that houses the 20 or so stacks of ballot boxes 40, and costs altogether about $4,000. In the touch screen system, the voter occupies one of the eight $6,000 booths for 15 to 25 minutes, for an overall cost of about 15 times the cost for use of the herein disclosed voting system. It is safe to say that the relative cost of the "Save Democracy" system is somewhere in the range of 5 to 10 percent of that of the touch screen system. (In the case of a comparison with the optical scanning plus tabulator, the 5 to 10 percent figure rises to 10 to 20 percent). In addition, eliminating the cost of tabulation via memory cards or the like is a major advantage.

Speed: Counting the time the e-system voter has to waste standing in line rather than sitting at a low-cost work-table, the total time spent by a voter using the election system described herein is expected to be only about half that taken to vote in the e-voting system. The system of the invention has no need for manual vote counting, so tabulation speed is always greater than that of the e-voting system, without the vulnerability to malfeasance.

Regarding voter errors or manipulations, it is inevitable that in the system described herein a small number of "wrong slot" insertions may occur. However, because the voter has been given a watchdog roll in the tabulation, in the form of a visual confirmation of the accuracy of the tabulation, of his/her own votes, it is to be expected that the incidence of voter error may be an order of magnitude smaller than that of any prior art voting systems.

It will be evident that if all the odometer display numbers are set to 000 when the polling place opens on election day, then the first person who votes will leave the digit "1" showing in the odometer display of each module where that first person inserted each ballot card. This fact is discernible by the next (second) voter, who may see the "1" digits and know who the first voter chose to vote for. This problem may be easily avoided by having the pollworkers vote first, just before the polling place opens, so that the odometer displays are not all set to zero when the first voters of the day arrive at the polling place.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A method for conducting an election and preventing rigging of the election, including the steps of:

providing a ballot consisting of a plurality of cards, each card presenting a single issue or contest to be voted on, providing a plurality of ballot boxes, each adapted to receive said cards, each of said ballot boxes identified as receiving all of one kind of single issue or contest cards, casting the ballot by inserting said cards into the respective single issue ballot boxes; and, counting each card as it is inserted into one of said ballot boxes, whereby each ballot is tabulated as it is cast by the voter;

providing a plurality of ballot card counters, each operatively associated with one of said plurality of ballot boxes, to perform said step of counting each card as it is inserted in each of said ballot boxes;

further including providing an indicator on each of said plurality of ballot card counters to verify that each of said ballot cards is tabulated as it is inserted in a ballot box.

2. The method for conducting an election of claim 1, wherein said indicator comprises a counter having a display, and the rightmost digit of said counter is arranged to be viewed by a voter as each card is inserted in each of said ballot boxes.

3. The method for conducting an election of claim 2, wherein said counter is free of any electric or electronic actuation, and shall be construed as providing the official election returns.

4. The method for conducting an election of claim 1, wherein said counter is connected to be driven by a rack-and-pinion mechanism that causes the insertion movement of the ballot card to advance said counter display.

5. The method for conducting an election of claim 4, wherein each of said ballot cards includes a line of holes formed therein, and said rack-and-pinion mechanism is provided with a pinion gear form having pinion tooth members and spacing sufficient to be engaged and driven by said line of holes in one of said ballot cards.

6. The method for conducting an election of claim 5, wherein said line of holes consists of a series of equally spaced holes in a line parallel to one edge of said card and having the spacing of adjacent holes equal to the circular pitch of the teeth of said pinion gear which engages said holes and causes the insertion of said card to rotate the input shaft of said counter.

7. The method for conducting an election of claim 6, wherein the length of said card is substantially equal to the pitch circumference of said pinion gear.

8. The method for conducting an election of claim 1, wherein said counter is certified to display an exact count of inserted cards, and wherein said counter is sealed to prevent any modification of card counter gear ratios after certification.

9. The method for conducting an election of claim 2, wherein all of the display digits of said counter are concealed from the voter except the right-most digit, said concealment being provided by a small lockable panel that covers all of said display digits except said right-most one.

10. The method for conducting an election of claim 9, further including providing a mechanism to prevent said rack-and-pinion mechanism from turning in reverse rotation to said insertion direction.

11. A method for conducting an election and preventing rigging of the election, including the steps of:

providing a ballot consisting of a plurality of cards, each card presenting a single issue or contest to be voted on, providing a plurality of ballot boxes, each adapted to receive said cards, each of said ballot boxes identified as receiving all of one kind of single issue or contest cards, casting the ballot by inserting said cards into the respective single issue ballot boxes; and, counting each card as it is inserted into one of said ballot boxes, whereby each ballot is tabulated as it is cast by the voter;

further including the step of providing a voting booth, said ballot boxes being displayed within said voting booth.

12. The method for conducting an election of claim 11, further including providing one of said ballot boxes for each of said voting choices for said issues or contests to be voted on, whereby the voting choice is exercised by placing the ballot card in the ballot box that represents the respective voting choice.

13. The method for conducting an election of claim 11, wherein said booth includes curtain means for providing the voter with privacy within said voting booth.

14. The method for conducting an election of claim 11, wherein said ballot boxes are all provided with the same width, depth, and height, and are assembled together in an array that extends horizontally and vertically.

15. The method for conducting an election of claim 14, wherein said ballot boxes are arranged by office and proposition in said horizontal direction, and in the vertical direction comprise stacks ordered by candidates for office and choices for propositions.

16. The method for conducting an election of claim 15, wherein one of the vertical ballot box stacks may be divided into at least two adjacent columns.

17. A method for conducting an election and preventing rigging of the election, including the steps of:

providing a ballot consisting of a plurality of cards, each card presenting a single issue or contest to be voted on, providing a plurality of ballot boxes, each adapted to receive said cards, each of said ballot boxes identified as receiving all of one kind of single issue or contest cards, casting the ballot by inserting said cards into the respective single issue ballot boxes; and, counting each card as it is inserted into one of said ballot boxes, whereby each ballot is tabulated as it is cast by the voter;

providing a plurality of ballot card counters, each operatively associated with one of said plurality of ballot boxes, to perform said step of counting each card as it is inserted in each of said ballot boxes;

further including the step, when the election has ended, of recording the tabulated number of ballots inserted in each of said ballot boxes, comparing the tabulated number to the number of ballot decks issued to voters at the polling place, and asserting election tampering if the sum of the card counter displays of a top issue ballot box exceeds the number of ballot card decks issued during the full election day.

18. A method for conducting an election and preventing rigging of the election, including the steps of:

providing a ballot consisting of a plurality of cards, each card presenting a single issue or contest to be voted on, providing a plurality of ballot boxes, each adapted to receive said cards, each of said ballot boxes identified as receiving all of one kind of single issue or contest cards, casting the ballot by inserting said cards into the respective single issue ballot boxes; and, counting each card as it is inserted into one of said ballot boxes, whereby each ballot is tabulated as it is cast by the voter;

providing a plurality of ballot card counters, each operatively associated with one of said plurality of ballot boxes, to perform said step of counting each card as it is inserted in each of said ballot boxes;

further including the step of tabulation of absentee ballot totals based on card counter displays at the county counting center appropriately overseen by surrogate voters of all participating parties.

19. A method for conducting an election and preventing rigging of the election, including the steps of:

providing a ballot consisting of a plurality of cards, each card presenting a single issue or contest to be voted on, providing a plurality of ballot boxes, each adapted to receive said cards, each of said ballot boxes identified as receiving all of one kind of single issue or contest cards, casting the ballot by inserting said cards into the respective single issue ballot boxes; and, counting each card as it is inserted into one of said ballot boxes, whereby each ballot is tabulated as it is cast by the voter;

wherein each choice for each candidate and issue to be voted on is provided with its own respective ballot box with separately certified odometer.

* * * * *